United States Patent [19]

Spring

[11] Patent Number: 4,646,982

[45] Date of Patent: Mar. 3, 1987

[54] BOBBIN WINDING DEVICE FOR SEWING MACHINES

[75] Inventor: Andreas Spring, Steckborn, Switzerland

[73] Assignee: F. Gegauf AG Bernina-Nähmaschinenfabrik, Steckborn, Switzerland

[21] Appl. No.: 823,651

[22] Filed: Jan. 29, 1986

[30] Foreign Application Priority Data

Feb. 7, 1985 [CH] Switzerland ..... 556/85

[51] Int. Cl.[4] ..... B65H 54/00; B65H 63/08; B65H 75/32

[52] U.S. Cl. ..... 242/20; 112/279; 242/21; 242/22; 242/47; 242/48; 242/49

[58] Field of Search ..... 242/20, 21, 22, 23, 242/24, 47, 48, 49, 36, 39, 16, 17, 18, 25 R; 112/279, 186

[56] References Cited

U.S. PATENT DOCUMENTS

| | | | |
|---|---|---|---|
| 332,771 | 12/1885 | Abercrombie | 242/21 |
| 1,210,643 | 1/1917 | Hayes | 242/21 |
| 1,848,352 | 3/1932 | Kelso | 242/22 |
| 2,255,152 | 9/1941 | Colegrove | 242/22 |
| 2,733,867 | 2/1956 | Ayres | 242/22 |
| 2,871,809 | 2/1959 | Moro | 242/20 X |
| 3,670,974 | 6/1972 | Ueltschi | 242/22 |
| 3,741,492 | 6/1973 | Johansson | 242/20 |
| 4,096,812 | 6/1978 | Gegauf | 242/22 X |

FOREIGN PATENT DOCUMENTS

| | | | |
|---|---|---|---|
| 3501638 | 8/1985 | Fed. Rep. of Germany | 112/279 |
| 146570 | 6/1920 | United Kingdom | 242/21 |
| 803156 | 10/1958 | United Kingdom | 112/279 |

*Primary Examiner*—Stanley N. Gilreath
*Attorney, Agent, or Firm*—Peter K. Kontler

[57] ABSTRACT

A self-sustaining bobbin winding device for use in a sewing machine has a driving unit which carries the bobbin during winding of a thread onto its core, and such unit is driven by an electric motor which can be arrested in response to actuating of an electric switch. The switch is actuated by one arm of a three-armed lever another arm of which is caused to bear against the roll of convoluted thread on the rotating bobbin and initiates a stoppage of the motor when the bobbin has collected a preselected length of thread. The third arm of the lever can be depressed by hand to disengage the other arm from the convoluted thread and to actuate the switch at the will of the operator. A first thread cutting tool is provided on the third arm of the lever, and a second thread cutting tool is provided on the driving unit.

19 Claims, 4 Drawing Figures

BOBBIN WINDING DEVICE FOR SEWING MACHINES

BACKGROUND OF THE INVENTION

The present invention relates to sewing machines in general, and more particularly to improvements in bobbin winding devices which are used in such machines to draw a thread from a relatively large spool and to convolute the thus withdrawn thread onto the bobbin for the lower thread.

Commonly owned German Offenlegungsschrift No. 35 01 638 discloses a bobbin winding device wherein a lever is pivotably mounted adjacent to the unit which drives the bobbin during winding of a thread on its core. The lever has a first arm which scans the diameter of the convoluted thread and a second arm which is used to arrest the motor for the bobbin driving unit. The first arm is accessible so that it can be manually engaged by a finger of the operator in order to terminate the winding of the thread onto the bobbin whenever desired. Such winding devices are not entirely satisfactory because the operator can injure her or his hand as a result of moving it too close to the rotating bobbin.

OBJECTS AND SUMMARY OF THE INVENTION

An object of the invention is to provide a novel and improved bobbin winding device which is constructed and assembled in such a way that the operator can interrupt the winding operation whenever desired without risking injury to the hand which is used to interrupt the winding operation.

Another object of the invention is to provide a simple, compact and self-sustained winding unit which can be installed in or on any of a number of different portions of the housing of a sewing machine.

A further object of the invention is to provide the bobbin winding device with novel and improved means for automatically interrupting the winding operation when the bobbin has stored a predetermined quantity of thread.

An additional object of the invention is to provide the bobbin winding device with novel and improved means for severing the thread upon completion of the winding operation.

Still another object of the invention is to provide the bobbin winding device with severing means which cannot injure the hand of the operator.

A further object of the invention is to provide a bobbin winding machine which renders it possible to sever the thread without it being necessary to use scissors or other discrete tools.

Another object of the invention is to provide a bobbin winding device which can be used as a simpler, more versatile and more reliable substitute for heretofore known bobbin winding devices and which can be installed in existing sewing machines in lieu of conventional devices.

Still another object of the invention is to provide an adjustable bobbin winding device which can be set to determine the length of a thread to be convoluted onto the core of a bobbin.

One feature of the invention resides in the provision of a bobbin winding device for convoluting selected lengths of a thread onto a bobbin in a sewing machine. The improved device comprises a support (the support can constitute a portion of the housing of the sewing machine), a rotary bobbin driving unit which is mounted in the support, a prime mover (e.g., an electric motor) for the driving unit, an electric switch or other suitable means for arresting the prime mover, and means for actuating the arresting means. The actuating means comprises a first portion which is movably mounted in the support, which serves to monitor the supply of thread that is convoluted on the bobbin while the latter is driven by the aforementioned unit, and which is movable between a plurality of different positions in response to changes in the quantity of thread on the bobbin. The actuating means further comprises a second portion which shares the movements of the first portion and is movable to a predetermined position in which it actuates the arresting means for the prime mover, and a third portion which is movable by hand to disengage the first portion from the thread on the bobbin and to move the second portion to the predetermined position independently of the quantity of thread on the bobbin. The actuating means preferably includes or constitutes a lever which is pivotable with reference to the support about a predetermined axis. Each portion of the actuating means can constitute a discrete arm of the lever.

One portion of the actuating means can comprise a thread cutting tool. Such tool is preferably provided on the third portion of the actuating means, and the third portion is preferably provided with means (e.g., a suitable protuberance) for preventing the hand which is used to move the third portion from reaching the thread cutting tool.

A thread cutting tool can be provided in or on the driving unit for the bobbin, and such tool can be provided with a substantially annular cutting edge. For example, the tool can include a sleeve one end portion of which is provided with a circular cutting edge, and the driving unit can further comprise a flange which is provided with a preferably ring-shaped recess adjacent to the cutting edge and serving to allow for manually induced movement of a thread against the cutting edge.

The improved bobbin winding device preferably further comprises a so-called setting member which is pivotally mounted in or on the support for movement to and to both sides of a dead-center position, means for coupling the setting member to the actuating means so that the setting member can move the aforementioned portions of the actuating means or vice versa, and means for yieldably biasing the setting member to either side of its dead-center position in such a way that, when the actuating means moves the setting member from one side of the dead-center position to and slightly beyond the dead-center position, the biasing means propels the setting member to the other side of the dead-center position with resulting disengagement of the first portion of actuating means from convoluted thread on the bobbin which is rotated by the driving unit and automatic propulsion of the second portion of the actuating means to its predetermined position (i.e., the biasing means can cause the arresting means to stop the prime mover). The coupling means can comprise mating teeth on the setting member and on the second portion of the actuating means. The setting member can comprise, or it can constitute, a lever having a first arm with teeth which mate with the teeth on the second portion of the actuating means and a second arm having means for allowing attachment of the biasing means thereto. The biasing means can comprise a prestressed tension spring (e.g., a coil spring), and the second arm of the setting member is preferably provided with means for facilitating attachment of the spring in several positions so as to select that angular position of the setting member which coincides with the dead-center position. The second arm of the setting member can have several notches for a portion of the spring.

Another feature of the invention resides in the provision of a device for convoluting selected lengths of a thread onto bobbins in a sewing machine wherein the rotary bobbin driving unit is mounted in its support (such as the aforementioned housing of the sewing machine). The device comprises a thread cutting or severing tool on or in the driving unit, preferably in close proximity of the location for the bobbin. The driving unit can comprise a driven shaft and a sleeve-like bobbin-driving element which is preferably separably coupled to and shares the angular movements of the shaft. The tool can be provided on or can constitute such sleeve-like element. The element is preferably provided with an annular end portion which constitutes or carries the cutting tool. A flange on the shaft of the driving unit is preferably mounted opposite the annular end portion of the sleeve-like element and is preferably provided with a recess (e.g., with an annular recess) which is adjacent to the tool and allows for manually induced movement of a thread against the tool (e.g., when the winding of a preselected quantity of thread onto the bobbin is completed and the convoluted length must be severed from the thread in the main supply, e.g., a large spool).

The prime mover for the driving unit can constitute the aforementioned electric motor, and the actuating means for the arresting means is preferably configurated and mounted in such a way that at least two of its portions are located in a plane including the axis of the driving unit. The aforementioned tension spring normally biases the first portion of the actuating means against the thread which is already convoluted onto the core of the bobbin (the latter can surround the sleeve-like element of the driving unit). The cutting tool of or on the driving unit can be provided in addition to or in lieu of the cutting tool on the actuating means.

The novel features which are considered as characteristic of the invention are set forth in particular in the appended claims. The improved bobbin winding device itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
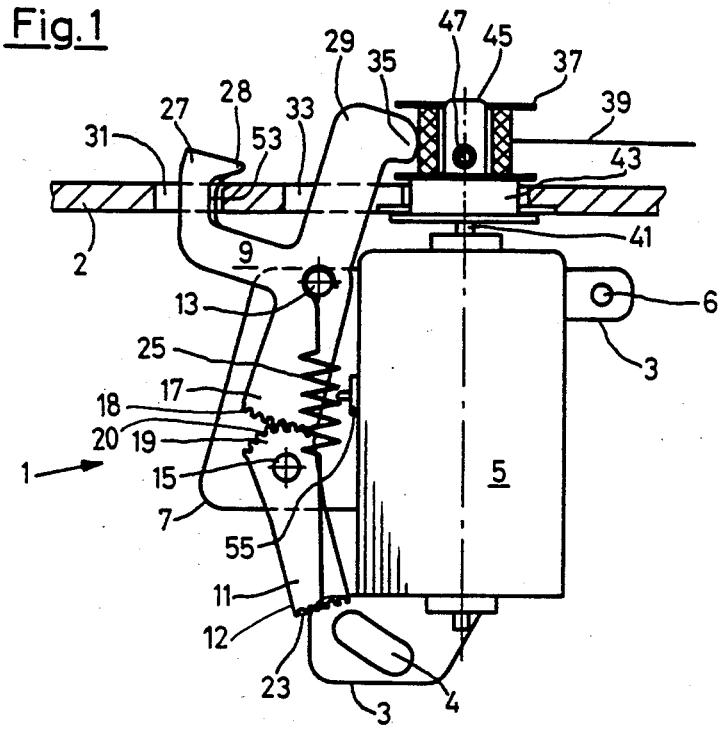
FIG. 1 is an elevational view of a bobbin winding device which embodies the invention, the actuating means being shown in a position its portions assume when the bobbin is in the process of collecting thread on its core.

The bobbin winding device 1 which is shown in FIGS. 1 to 4 constitutes a self-supporting assembly which can be mounted in or on any one of several portions of the housing 2 of a sewing machine. If desired, the device 1 can be integrated into the housing 2. In the illustrated embodiment, the casing of a prime mover 5 (e.g., a small electric motor) has several lugs 3 one of which has a circular hole 6 for the shank of a screw serving to separably secure the prime mover 5 to the housing 2. Another lug 3 has an elongated slot 4 which can receive the shank of a second screw and enables the person installing the device 1 in the housing 2 to change the orientation of the output shaft 41 of the prime mover by the simple expedient of loosening the screw for the lower lug 3 and by thereupon pivoting the prime mover 5 about the axis of the shank of the screw extending through the circular opening 6 of the upper lug 3. Proper orientation of the axis of the output shaft 41 is important because this ensures predictable winding of a thread 39 onto the core of a bobbin 37 which is rotated by the driving unit including the output shaft 41.

Figure 2:
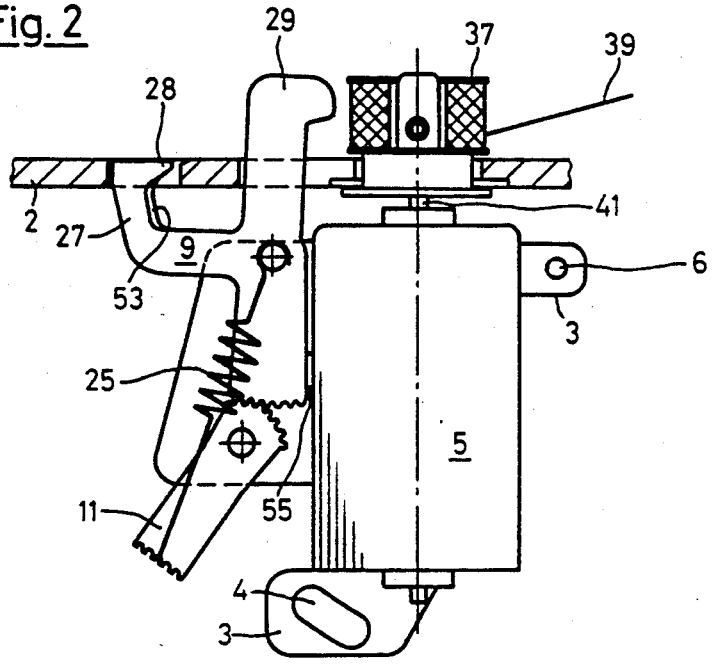
FIG. 2 is a similar view but showing the actuating means in a position in which its second portion causes the arresting means to stop the prime mover for the driving unit.
Figure 3:
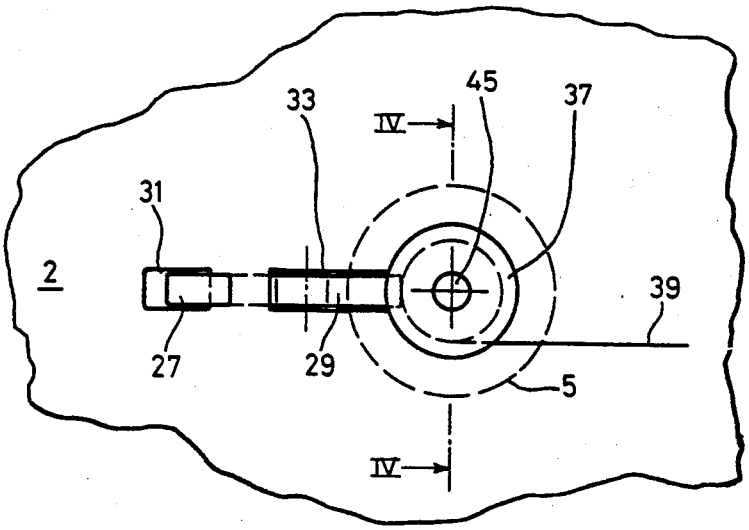
FIG. 3 is a plan view of the structure which is shown in FIG. 1.

The casing of the prime mover 5 is further provided with a laterally extending plate-like support or carrier 7 for two parallel horizontal pivot pins 13 and 15. The upper pin 13 carries an actuating unit 9 for a normally closed arresting switch 55 in the circuit of the prime mover 5. Thus, the unit 9 must actuate the arresting switch 55 in order to stop the prime mover 5 and the bobbin 37. In accordance with a feature of the invention, the actuating unit 9 is a three-armed lever including a first portion or arm 29 which has a pallet 35 normally engaging the outermost layer of the roll of convolutions of thread 39 on the core of the bobbin 37, and a second portion or arm 17 which shares the pivotal movements of the arm 29 and can depress and thereby open the switch 55 when it reaches a predetermined angular position, i.e., when the arm 29 assumes a preselected angular position of a large number of different positions, each corresponding to a different diameter of the roll of convoluted thread 39 on the core of the bobbin 37. The thread 39 is supplied by a suitable source, e.g., by a relatively large spool (not shown) which can rotate on a spindle provided therefor on the housing 2 of the sewing machine. It is assumed that the spool is located to the right of the bobbin 37, as seen in FIG. 1, 2 or 3 of the drawing.

The device 1 further comprises a so-called setting member 11 which is a two-armed lever pivotable about the axis of the pin 15 and having an upper arm 19 serving to receive motion from, or to transmit motion to, the lever 9 and a lower arm 12 which is adjustably connected to the lower end portion of a prestressed coil spring 25 serving as a means for indirectly and yieldably biasing the pallet 35 of the arm 29 against the roll of convoluted thread 39 on the bobbin 37 in certain angular positions of the setting member or lever 11. The teeth 20 of the arm 19 mate with complementary teeth 18 on the arm 17, and such teeth together constitute a coupling which compels the lever 9 to change its angular position in response to pivoting of the lever 11 under the action of the spring 25 and which further compels the lever 11 to change its angular position in response to pivoting of the lever 9 while the diameter of the roll of convoluted thread 39 on the bobbin 37 increases or in response to manual pivoting of the lever 9 in response to depression of a third portion or arm 27. In FIG. 1, the upper parts of the arms 27 and 29 extend upwardly beyond the illustrated portion of the housing 2 through suitable windows 31 and 33 whose dimensions are selected with a view to allow for pivoting of the lever 9 through an angle slightly exceeding that which is covered by this lever during movement between the positions of FIG. 1 (the pallet 35 bears against the thread on the core of the bobbin 37) and FIG. 2 (the arm 29 is spaced apart from the convoluted thread 39 and the arm 17 maintains the movable portion of the arresting switch 55 in depressed position so that the prime mover 5 is at a standstill).

The lower arm 12 of the lever 11 has a set of notches 23 which alternate with teeth and each of which can receive and retain the lower end portion of the tension spring 25 whose upper end portion is attached to the pivot pin 13 for the three-armed lever 9.

In FIG. 1, the spring 25 cooperates with the lever 11 to bias the lever 9 in a clockwise direction, i.e., the pallet 35 is compelled to bear against the convoluted thread 39. In FIG. 2, the spring 25 cooperates with the lever 11 to bias the lever 9 in a counterclockwise direction, and the extent of such pivotal movement is limited by the arm 17 and arresting switch 55. At such time, a protuberance or tooth 28 at the upper end of the arm 27 is confined in the respective window 31 of the housing 2 and the arm 29 is close to the surface bounding the left-hand end of the window 33. In order to propel the lever 9 to the position of FIG. 2, the lever 11 must reach and move beyond a dead-center position in which the axis of the pivot pin 15 is located on a line connecting the upper and lower end portions of the tension spring 25. It will be seen that the dead-center position of the lever 11 can be changed by the simple expedient of placing the lower end portion of the spring 25 into a different notch 23 of the lower arm 12 of the lever 11. The lever 11 is located at one side of its dead center position while the spring 25 is free to urge the pallet 35 against the convoluted thread 39 on the core of the bobbin 37, and the lever 11 is located at the other side of such dead-center position when the spring 25 is free to keep the pallet 35 away from the bobbin and its thread. The setting lever 11 can be said to constitute a flip-flop type trip for the arresting switch 55.

The arm 29 of the lever 9 is substantially aligned with the arm 17, and the major part (or a substantial part) of the arm 27 extends substantially at right angles to the elongated structure including the arms 17 and 29. The uppermost portion of the arm 27 can be depressed by hand (to thereby move the lever 9 to the angular position of FIG. 2) at any stage of the winding operation, i.e., the operator can disregard the setting of the lower end portion of the spring 25 and decide to arrest the prime mover 5 when the core of the bobbin 37 has collected a desired length of thread, i.e., before the switch 55 is opened as a result of counterclockwise pivoting of the lever 9 solely under the action of the convoluted thread.

Figure 4:
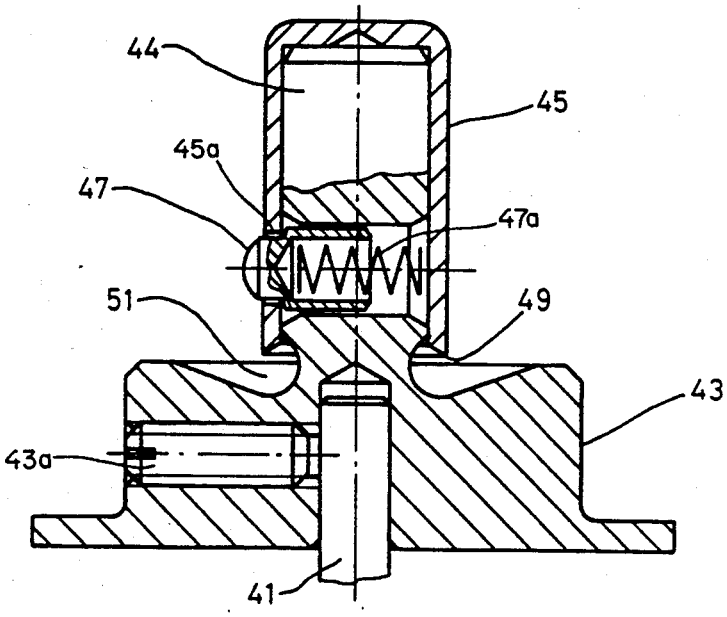
FIG. 4 is an enlarged sectional view as seen in the direction of arrows from the line IV—IV of FIG. 3.

As can be seen in FIG. 4, the output shaft 41 of the prime mover 5 is separably affixed (by a screw 43*a*) to a flange 43 which is adjacent to the lower end portion of a sleeve-like torque transmitting element 45. The element 45 is applied over a stub 44 which is coaxial with the shaft 41 and constitutes an upward extension of the flange 43. A plunger 47 in a diametrically extending bore of the stub 44 is biased into a hole 45*a* of the sleeve-like element 45 by a spring 47*a*, and its spherical head extends into a socket which is provided therefor in the core of the bobbin 37 when the latter is slipped onto the element 45. The bobbin 37 is then compelled to share all angular movements of the shaft 41. The parts 41, 43, 45, 47 can be said to constitute a driving unit which serves to transmit torque from the prime mover 5 to the bobbin 37 so that the latter can wind the thread 39 onto its core as long as the prime mover is on.

In accordance with another feature of the invention, the lower end portion of the sleeve-like element 45 constitutes a cutting or severing tool with an annular cutting edge 49 which can be used to sever the thread 39 as soon as the bobbin 37 has accumulated a requisite length of thread. In order to facilitate the task of an operator who wishes to sever the thread 39 by the cutting edge 49, the flange 43 of the driving unit has an annular recess 51 whose outline resembles that of one-half of a tear drop and whose depth increases in a direction from the radially outermost portion of the upper side of the flange 43 toward the common axis of the shaft 41 and stub 44.

If desired, the flange 43 can constitute an integral portion of the output shaft 41 of the prime mover 5, i.e., such output shaft can carry the torque transmitting plunger 47 and can directly support the element 45 and its severing tool including the cutting edge 49. The element 45 can be made of a suitable metallic material (e.g., steel) and its lower end portion can be ground or otherwise machined to provide a reasonably sharp cutting edge 49. Such cutting edge is not accessible to the fingers of the operator but can be readily reached by a portion of the thread 39 in response to relatively simple manipulation of the thread by the user of the sewing machine.

The cutting edge 49 can be readily reached by a thread 39 paid out by a spool which is located to the right of the winding device 1, as viewed in FIG. 1, 2 or 3. In order to simplify severing of the thread if the main source of thread is located to the left of the winding device 1, the latter preferably comprises a second severing or cutting tool 53 which is provided on the lever 9, preferably on the arm 27 at a level below the protuberance 28 so that it cannot be reached by a finger of the operator but is immediately accessible to a selected portion of the thread when the lever 9 is in or close to the position of FIG. 1. The tool 53 may constitute a short blade which is recessed into the arm 27 or which can be embedded in such arm at the time the lever 9 is formed in an injection molding or other suitable machine for the processing of synthetic plastic materials. The protuberance 28 constitutes a shield or shroud at a level above the cutting tool 53 and the latter is fully concealed in the housing 2 when the lever 9 is caused to assume the position of FIG. 2. The protuberance 28 further facilitates engagement between a selected portion of the thread and the tool 53 because it acts not unlike a hook which prevents the thread which is partially looped around the arm 27 from sliding upwardly and off such arm 27.

The mode of operation of the improved winding device 1 is as follows:

The leader of the thread 39 is affixed to the bobbin 37 before or after the prime mover 5 is set in motion. The prime mover 5 can be arrested by the simple expedient of depressing the arm 27 of the three-armed lever 9 to the position of FIG. 2. When the arm 27 is released, the arm 17 releases the switch 55 which completes the circuit of the prime mover 5 so that the bobbin 37 is rotated by the driving unit including the element 45 and the plunger 47 in the stub 44 on the flange 43. The spring 25 then cooperates with the setting lever 11 to bias the pallet 35 of the arm 29 against the growing roll of convoluted thread 39 on the core of the bobbin 37 whereby the lever 9 gradually pivots in a counterclockwise direction and the lever 11 approaches its dead-center position. When the longitudinal axis of the spring 25 moves from one side to the other side of the axis of the pivot pin 15, the lever 11 snaps over to the other side of its dead-center position and comes to rest in the angular position of FIG. 2 in which the arm 17 maintains the switch 55 in open position (i.e., the prime mover 5 is stopped) and the pallet 35 of the arm 29 is sufficiently remote from the roll of convoluted thread 39 to allow for lifting of the bobbin 37 off the stub 45. The thread 39 is then severed adjacent to the bobbin 37 by causing it to engage the cutting edge 49 at the lower end of the element 45. The timing of abrupt movement of the levers 9 and 11 to the end positions of FIG. 2 can be changed by moving the lower end portion of the spring 25 into a different notch 23 of the arm 12. An even more accurate adjustment of the timing of movement of the levers 9, 11 to the positions of FIG. 2 can be selected by changing the initial mutual angular positions of these levers, e.g., by detaching the spring 25 from the lever 11 when the latter is held in the position of FIG. 2, by thereupon detaching the lever 11 from the pivot pin 15, by mounting the lever 11 on the pin 15 in a different angular position (i.e., by placing one or more selected teeth 20 of the coupling 18, 20 into mesh with a different set of teeth 18 on the arm 17), and by attaching the lower end of the spring 25 to a different portion of the arm 12. The levers 9 and 11 will move to the positions of FIG. 2 sooner if the lower end portion of the spring 25 is attached to the lever 11 nearer to the left-hand side of the lower arm 12, i.e., if such lower end portion of the spring is inserted into the leftmost notch 23 or into one of the notches which are more distant from the casing of the prime mover 5.

If the operator wishes to interrupt the winding of the thread 39 before the prime mover 5 is automatically arrested in response to monitoring of the diameter of the roll of thread on the bobbin 37, the arm 27 is simply depressed and the lever 11 immediately snaps over to the end position of FIG. 2 while the arm 17 actuates the switch 55 in a sense to stop the prime mover 5. Depression of the lever 27 is terminated automatically as soon as the switch 55 stops further counterclockwise pivotal movement of the lever 9, i.e., the same as if the lever 9 were pivoted solely by the spring 25 and lever 11 in response to detection (by the pallet 35) that the diameter of the roll of convoluted thread 39 has been increased to the preselected value.

The operator may wish to use the cutting tool 53 if the main source of thread 39 is located to the left of the windows 31, 33 in the housing 2 of the sewing machine. However, either of the two cutting or severing tools can be used regardless of whether the main source of supply of thread 39 is located to the left or to the right of the winding device 1.

The portions or arms 17, 27, 29 of the lever 9 are preferably located in a plane which includes the axis of the driving unit for the bobbin 37. The lever 11 is preferably also installed in such plane.

The window 31 is sufficiently remote from the stub 44 to ensure that the finger which is used to depress the arm 29 is not likely to come in contact with the rotating bobbin 37.

The cutting tools (i.e., the sleeve-like element 45 and the blade 53) render it possible to sever the thread 39 without scissors or other discrete implements which may not be available at the time the thread is to be cut upon completion of a winding operation.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A device for convoluting selected lengths of a thread onto bobbins in a sewing machine, comprising a support; a rotary bobbin driving unit mounted in said support; a thread cutting tool on said driving unit, said tool including a sleeve-like element having an end portion provided with a cutting edge and said driving unit comprising a flange having a recess adjacent to said cutting edge to allow for manually induced movement of a thread against the cutting edge; a prime mover for said unit; means for arresting said prime mover; and means for actuating said arresting means, including a first portion movably mounted in said support and arranged to monitor the supply of convoluted thread on the bobbin which is rotated by said unit, said first portion being movable between a plurality of different positions in response to changes in the quantity of thread on the bobbin, a second portion arranged to share the movements of said first portion and movable to a predetermined position in which it actuates said arresting means, and a third portion movable by hand to disengage said first portion from the thread on the bobbin and to move said second portion to said predetermined position independently of the quantity of thread on the bobbin.

2. The device of claim 1, wherein said actuating means includes a lever which is pivotable with reference to said support about a predetermined axis, each portion of said actuating means constituting an arm of said lever.

3. The device of claim 1, wherein one portion of said actuating means comprises a thread severing tool.

4. The device of claim 3, wherein said, thread severing tool is provided on the third portion of said actuating means.

5. A device for convoluting selected lengths of a thread onto bobbins in a sewing machine, comprising a support; a rotary bobbin driving unit mounted in said support; a prime mover for said unit; means for arresting said prime mover; means for actuating said arresting means, including a first portion movably mounted in said support and arranged to monitor the supply of convoluted thread on the bobbin which is rotated by said unit, said first portion being movable between a plurality of different positions in response to changes in the quantity of thread on the bobbin, a second portion arranged to share the movements of said first bobbin and movable to a predetermined position in which it actuates said arresting means, and a third portion movable by hand to disengage said first portion from the thread on the bobbin and to move said second portion to said predetermined position independently of the quantity of thread on the bobbin; a setting member pivotally mounted on said support for movement to a dead-center position and to both sides of said dead-center position; means for coupling said setting member to said actuating means so that the setting member can move said portions of the actuating means and vice versa; and means for yieldably biasing said setting member to either side of said dead-center position so that, when said actuating means moves the setting member from one side of said dead-center position to and beyond such dead-center position, the biasing means propels the setting member to the other side of the dead-center position with attendant disengagement of said first portion from the convoluted thread on the bobbin and propulsion of said second portion to said predetermined position.

6. The device of claim 5, further comprising a thread cutting tool on said driving unit.

7. The device of claim 6, wherein said tool has a substantially annular cutting edge.

8. The device of claim 6, wherein said tool includes a sleeve-like element having an end portion provided with a cutting edge and said driving unit further comprises a flange having a recess adjacent to said cutting edge to allow for manually induced movement of a thread against the cutting edge.

9. The device of claim 5, wherein said coupling means comprises mating teeth on said setting member and the second portion of said actuating means.

10. The device of claim 9, wherein said setting member comprises a lever having a first arm which has teeth mating with the teeth of said second portion and a second arm with means for attaching said biasing means thereto.

11. The device of claim 10, wherein said biasing means comprises a prestressed spring and said second arm has means for permitting attachment of the spring in several different positions so as to select that angular-position of said lever which coincides with said dead-center position.

12. The device of claim 11, wherein said spring is a tension spring and said second arm has several notches for a portion of said spring.

13. A device for convoluting selected lengths of a thread onto bobbins in a sewing machine, comprising a support; a rotary bobbin driving unit mounted in said support, said unit comprising a driven shaft and a sleeve-like bobbin driving element coupled to and arranged to share the angular movements of said shaft; and a thread cutting tool on said sleeve-like element.

14. The device of claim 13, wherein said element has an annular end portion which constitutes said cutting tool.

15. The device of claim 14, further comprising a flange provided on said shaft and having a recess adjacent to said end portion to allow for manually induced movement of a thread against said tool.

16. The device of claim 13, further comprising a prime mover for said driving unit, means for arresting said prime mover, and means for actuating said arresting means including a first portion movably mounted in said support and arranged to monitor the supply of thread on the bobbin which is rotated by said unit, said first portion being movable between a plurality of positions in response to changes in the quantity of thread on the bobbin, a second portion arranged to share the movements of said first portion and movable to a predetermined position in which it actuates said arresting means, and a third portion movable by hand to disengage said first portion from the thread and to move said second portion to said predetermined position independently of the quantity of thread on the bobbin, at least two portions of said actuating means being located in a plane which includes the axis of said unit.

17. The device of claim 16, further comprising means for normally biasing said first portion against the thread on the bobbin which is rotated by said unit.

18. The device of claim 16, further comprising a second thread cutting tool on said actuating means.

19. The device of claim 18, wherein said third portion includes means for preventing the hand which is used to move said third portion from reaching said second cutting tool.

* * * * *